United States Patent [19]

Alford et al.

[11] 4,166,585

[45] Sep. 4, 1979

[54] IMPACT CRUSHER TABLE CONSTRUCTION

[75] Inventors: Peter B. Alford, Cheshire; David F. Peaks, Eugene, both of Oreg.

[73] Assignee: El-Jay, Inc., Eugene, Oreg.

[21] Appl. No.: 858,812

[22] Filed: Dec. 9, 1977

[51] Int. Cl.[2] ..... B02C 19/00

[52] U.S. Cl. ..... 241/275; 51/434

[58] Field of Search ..... 241/275, DIG. 10; 51/434, 435

[56] References Cited

U.S. PATENT DOCUMENTS

| | | | |
|---|---|---|---|
| 3,474,974 | 10/1969 | Wood | 241/275 |
| 3,578,254 | 5/1971 | Wood | 241/275 |
| 3,767,127 | 10/1973 | Wood | 241/275 |
| 3,873,047 | 3/1975 | Johnson | 241/DIG. 10 |
| 4,065,063 | 12/1977 | Johnson | 241/275 |

*Primary Examiner*—Howard N. Goldberg

*Attorney, Agent, or Firm*—Haven E. Simmons; James C. Nemmers

[57] ABSTRACT

A rotary table for an impact crusher has upper and lower table plates grooved to receive restraining lugs on impeller shoes which are clamped between the plates. The grooves also receive the restraining lugs of segmental wear plates which are held in place, vertically, by having end portions fitting in notches formed conjointly by shoulders on the impeller shoes and the inner faces of the table plates. The latter and the shoes have lip portions to shield the outer edges of the table plates from wear.

10 Claims, 6 Drawing Figures

IMPACT CRUSHER TABLE CONSTRUCTION

FIELD OF INVENTION

The present invention relates to the field of impact rock crushers and particularly to an improved rotary table for such a crusher.

BACKGROUND OF THE INVENTION

The application of Louis W. Johnson, entitled "Improved Impact Crusher", Ser. No. 702,394, filed July 6, 1976, now U.S. Pat. No. 4,065,063 shows an impact crusher wherein the rotary table has a plurality of mounting blocks on which impeller shoes are mounted. There are segmental wear plates between the shoes bolted to the table plate.

SUMMARY OF THE INVENTION

In accordance with the present invention, the mounting blocks previously utilized are no longer used. Instead, the impeller shoes are clamped by bolts between a pair of table plates but are restrained from outward movement under the influence of centrifugal force by restraining lugs fitting in grooves on the table plates. Instead of plural segmental plates between shoes, in the present invention there is a single wear plate between a pair of shoes. These plates have restraining lugs fitting in the grooves of the table plates for resisting radial movement under the influence of centrifugal force and are held in place in a vertical direction by having end portions fitting into notches formed by the inner faces of the table plates and shoulders on the impeller shoes. The table plates are provided with plural holes so located that the number of shoes provided for a table can be altered merely by adding to or subtracting from the number already provided and relocating the shoes equidistant around the table plates. Altering the number of shoes means that the wear plates must be changed to those of appropriate size. The height of the table can be changed by merely substituting different height impeller shoes and different length clamping bolts for the ones in use. The remaining components remain unchanged, unless a different height and a different number of shoes is desired. If so, there must be a change in wear plate size as above indicated.

It is an object of the present invention to so simplify the previous construction of rock crusher tables as to reduce the number of parts required and to enable those components which are subject to substantial wear to be cast, and to be utilized, in their "as cast" condition without any, or substantially any grinding, in combination with other parts in assembling a table.

Another object of the invention is to provide a table wherein the parts can be rapidly interchanged and the table converted to one having greater or fewer number of shoes or to be converted to a taller or shorter table without having to change the table plates.

A further object of the invention is to so construct the impeller shoes that they not only function to hold themselves in place, but also hold the wear plates and the distributor cone or cap in place by specially formed shoulders on the impeller shoes.

Another object of the invention is to provide a rotary impact crusher table in which not only the components are fewer than before, but in which the components are interchangeable and in which certain components are formed with integral lip portions for shielding the edges of the table plates from wear.

BRIEF DESCRIPTION OF THE DRAWINGS

FIG. 1 embodying the concepts of the present invention with certain of the parts being shown schematically for convenience in illustration;

DESCRIPTION OF THE PREFERRED EMBODIMENT

Figure 1:
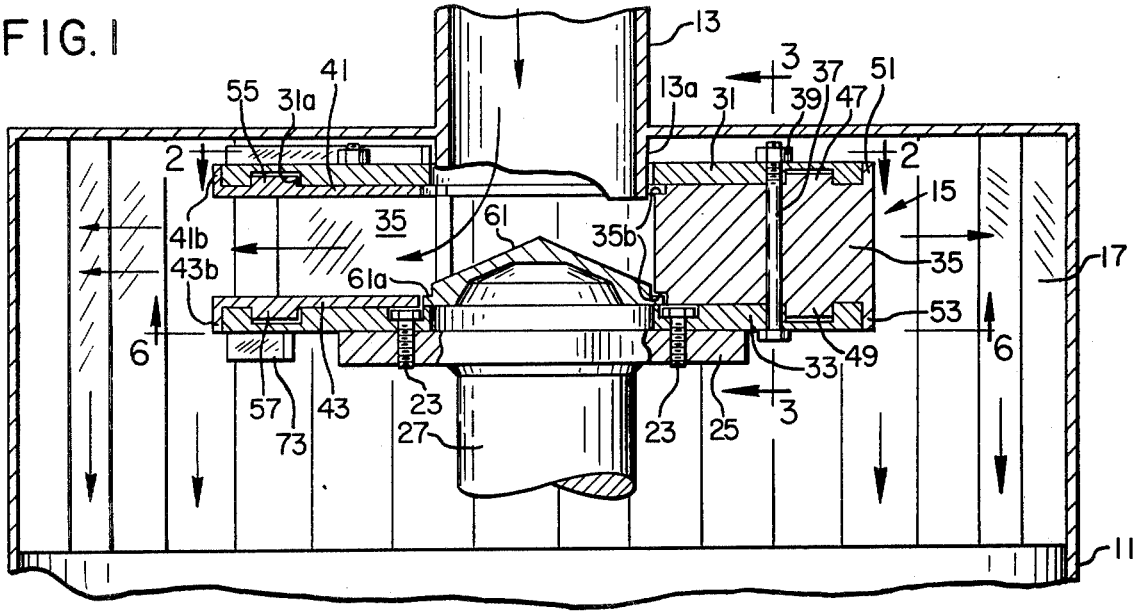
FIG. 1 is a vertical section through the upper part of a crusher taken along line 1—1 of FIG. 2.

FIG. 1 shows the upper portion of an impact crusher having a shell or main frame 11 provided with a centrally located feed spout 13 through which rock is fed to a rotating distributor table 15 which slings or throws the rock to be crushed outwardly against an anvil structure 17 mounted on the shell or frame 11.

Since the table 15 embodies the inventive concepts of the present invention, the remainder of the crusher has not been disclosed, or disclosed only schematically.

The table 15 is secured by capscrews 23 (FIG. 1) to a flange 25 of a drive shaft 27. The drive shaft and related structure can take any suitable form and may be like that in the prior patent to Johnson U.S. Pat. No. 3,873,047.

The table 15 comprises upper and lower table plates 31 and 33 of annular form spaced apart and sandwiching a plurality of impeller or slinger shoes 35. This assembly is secured together by plural bolts 37 and nuts 39, the bolts passing through appropriate holes in the table plates and slinger shoes.

Inasmuch as the slinger shoes will take considerable wear from the rock being handled by the distributor table, they must be formed of very hard wear resistant metal. Typically, this metal is so hard and brittle that it cannot be machined so that if it is to be precisely dimensioned, it must be ground. An aim of the present invention is to provide a construction which enables the slinger shoes to be cast to final form.

On the other hand, the upper and lower table plates 31 and 33 can be formed of mild steel and thus readily machined because the faces of these plates, which would otherwise be subject to substantial wear, are protected by the presence of the slinger shoes 35 and by plural segmental upper and lower wear plates 41 and 43, which are of identical form. These plates, because they must take substantial wear, will ideally be formed of a very hard metal; in fact, one so hard that for precise dimension, the metal must be ground, rather than machined. To avoid expensive grinding steps, the construction has been designed to enable such segmental wear plates to be cast to final form.

The slinger shoes 35 are held in place against the outward thrust created by centrifugal forces by being formed with upper and lower retaining lugs 47 and 49 which fit within annular grooves formed in the inner faces of the upper and lower table plates 31 and 33. The upper groove is shown in dotted lines in FIG. 2 and labeled 31a.

The fit of the bolt 37 in a slinger shoe 35 is sufficiently loose as to enable the retaining lugs 47 and 49 to bear outwardly against the outer annular walls of the table groove, so that such walls take the circumferential thrust forces rather than the bolt 37. This construction also enables the holes to be formed by a casting operation rather than having to be ground.

The slinger shoes are further formed with vertically extending lips 51 and 53 (FIG. 1) to protect the adjacent outer edge portions of the table plates from excessive wear because of flying rock in the zone between the exterior of the table 15 and the anvil structure 17.

The wear plates 41 and 43 are retained in place in a radial direction by being formed with retaining lugs 55 and 57 which fit within the annular table grooves. The wear plates are held against or in close adjacency to the inner faces of the table plates by lateral shoulders 35*a* (FIGS. 3 and 5) on the shoes which provide recesses or notches between such shoulders and the opposing faces of the table plates into which the end edges or end portions of the wear plates fit. Such end portions for plates 41 are labeled 41*a* in FIG. 2.

Figure 4:
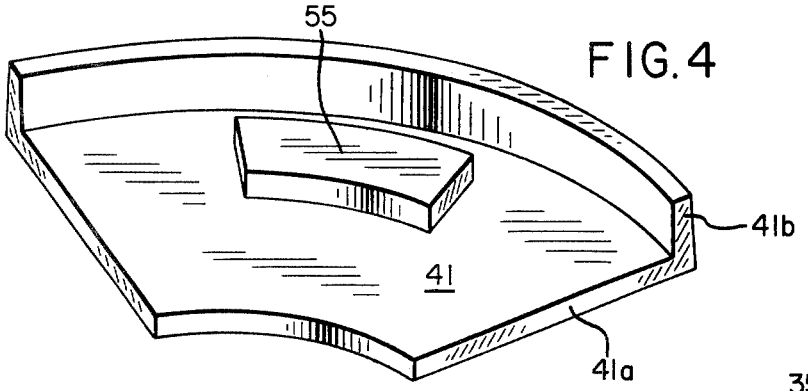
FIG. 4 is a perspective view of a wear plate.

Returning to FIGS. 1 and 4, each wear plate is provided with a vertical lip 41*b* in the case of wear plate 41, and 43*b* in the case of wear plate 43, to protect the outer edges of the table plates in the areas between the slinger shoes. In other words, the slinger shoe lips and the wear plate lips form a continuous lip (FIG. 2) extending around the entire table to protect the outer edges of the table plates against excessive wear.

Centrally of the table 15 is located a distributor cone or cap 61 which has an outwardly projecting flange-like edge 61*a* (FIG. 1) which fits in recesses formed by shoulders 35*b* on the slinger shoes and the opposing faces of the table plates 31 and 33.

The shoulders 35*a* and 35*b* are provided by an island-like strip provided on each of the upper and lower surfaces of each shoe.

Figure 2:
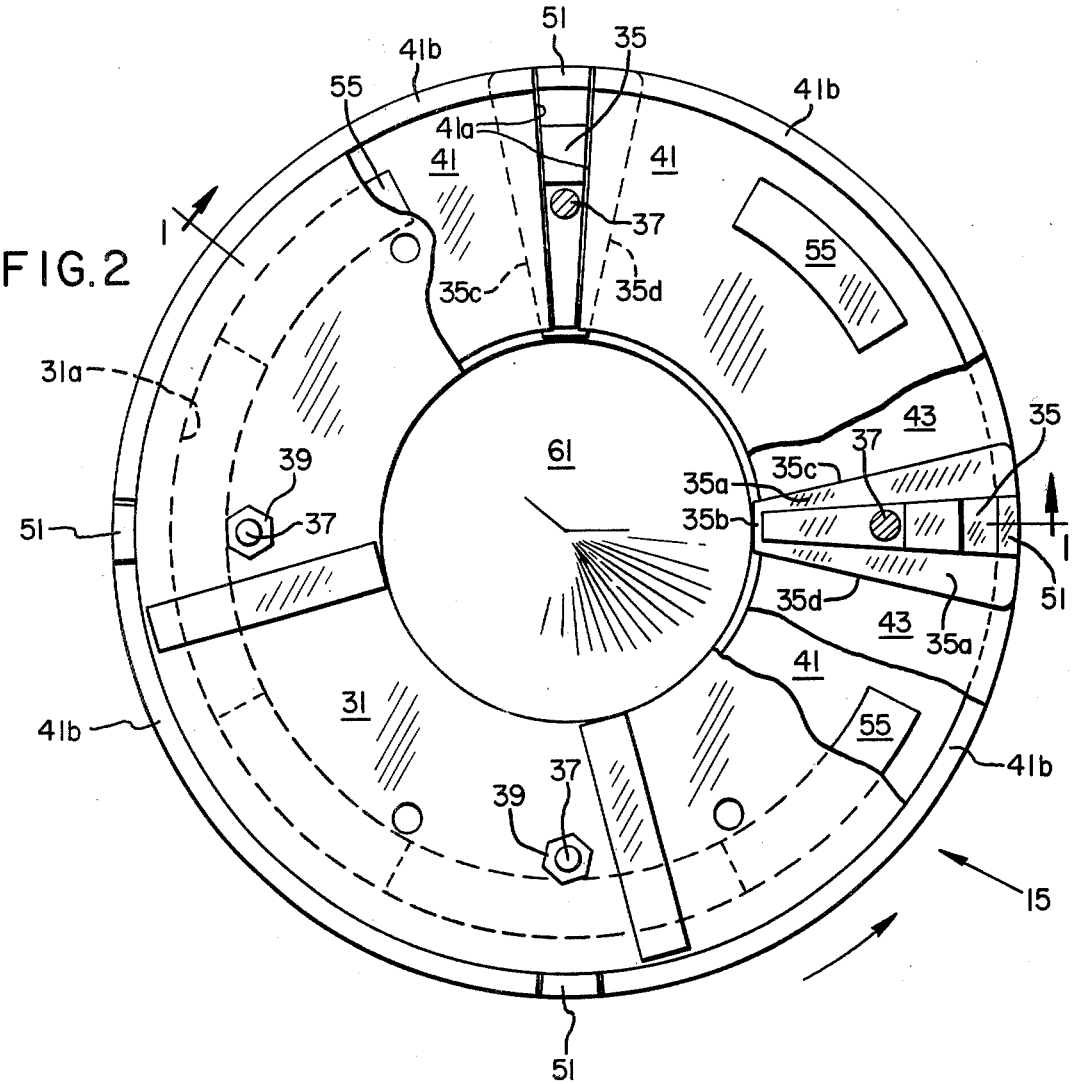
FIG. 2 is a plan view of the structure of FIG. 1, with parts broken away to different levels for convenience in illustration, the view being taken in the direction of the arrows 2—2 in FIG. 1.
Figure 5:
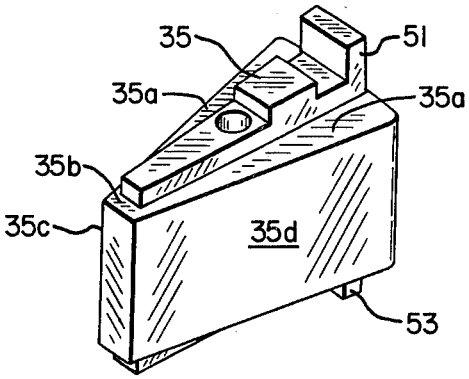
FIG. 5 is a perspective view of an impeller shoe.
Figure 3:
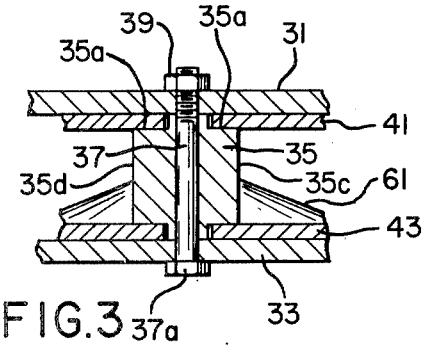
FIG. 3 is a fragmentary vertical section taken along line 3—3 of FIG. 1.

FIGS. 2 and 5 best show the general shape and form of a slinger shoe, where it is evident that the shoe is of wedge shape and tapers outwardly in a radial direction so that it is of minimal thickness at its inner end and maximum thickness at its outer end. Each shoe is provided with a pair of oppositely directed faces 35*c* and 35*d*. With the direction of rotation shown in FIG. 2, faces 35*c* constitute the wear faces.

It is further pointed out that the slinger shoes are symmetrically formed so that they can be inverted. Thus, assume that faces 35*c* have been subject to substantial wear, it is only necessary to invert the slinger shoes to locate the faces 35*d* in position for slinging rocks outwardly and thus taking the wear resulting from distribution of such rocks.

It is further pointed out that the segmental wear plates 41 and 43 are of identical construction so that only one form of wear plate need be manufactured for each shoe configuration. Thus the wear plates can be located either to function as the top wear plates or as the bottom wear plates. If the table is converted from 3 to 4 shoes, for example, a different set of wear plates must be used, since the angle or arc between the shoes changes.

It is still further pointed out that the wear on the distributor cone 61 will vary somewhat, with the surface area closest the wear faces of the slinger shoes being subjected to greater wear because of the travel of the rock thereacross. When this wear becomes unacceptable, the cone can be rotated to locate unworn portions next to the wear faces of the slinger shoes. Thus the wear on the cone can be distributed completely around the wearable surface of the cone.

Figure 6:
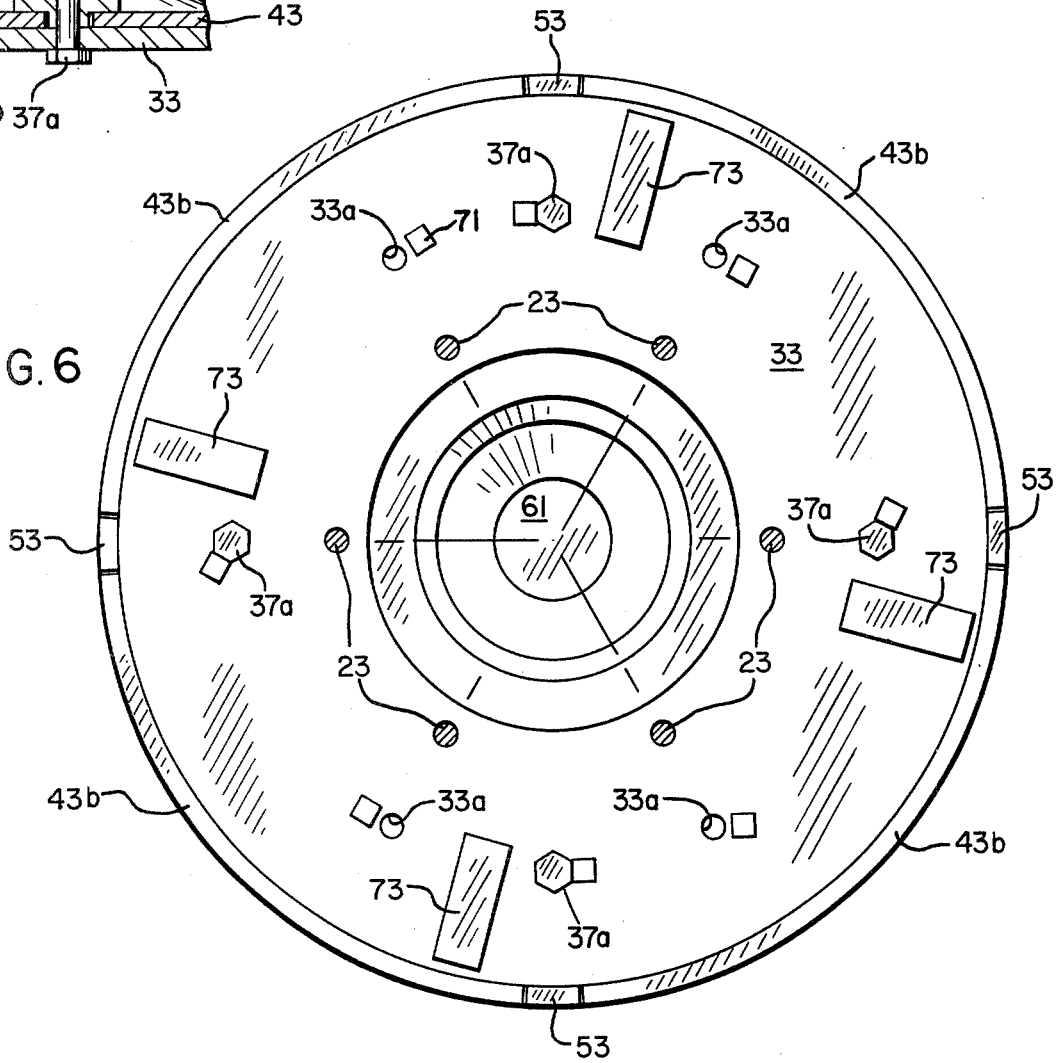
FIG. 6 is a bottom view of the table taken along line 6—6 of FIG. 1.

FIG. 6 shows the underside of the table and particularly the underside of the lower table plate 33. Note that there are eight holes 33*a* formed in the plate 33 to enable the slinger shoes to be located in different arrangements. With these eight holes, two slinger shoes can be provided diametrically opposite one another; or three shoes can be utilized located at 120° from each other; or four slinger shoes (as shown in FIG. 2) can be utilized; or by selectively utilizing other bolt holes, six slinger shoes can be mounted between the table plates. If desired, additional bolt holes could be provided to enable five slinger shoes to be mounted between the table plates.

FIG. 6 shows four bolt heads 37*a*. Adjacent each head and welded to the underside of the lower table plate is a small lug 71 which serves to preclude rotation of the heads 37*a* for convenience in assembly operations.

Distributed around the lower surface of the lower table plate are a series of shielding lugs 73 which are of sufficient height to prevent excessive wear of the heads 37*a* from the flying rock during rotation of the table.

Referring to FIG. 1, note that the feed spout 13 is formed with a downwardly projecting spout portion 13*a* so as to feed rock into the interior of the table 15. The extension 13*a* is so dimensioned as to preclude any substantial wear of the upper table plate 31. It is further pointed out that the narrow space between the upper portion of the table 15 and the top of the crusher shell 11 restricts entry of the flying rock to a considerable extent. Even so, it is deemed desirable to provide shielding lugs 73 on the upper surface of the upper table plate 31.

The spout portion 13*a* can be a cast replaceable part, so that only this part rather than the entire spout need be replaced when 13*a* wears excessively.

The impact table shown in FIG. 1 is a very simple form and can be readily disassembled and assembled by removal of only the bolts 37 which releases all of the table assembly components located above annular plate 33. The plate can then be separated by removal of the capscrews 23.

All of the various functions performed by the various parts in the construction shown in the prior application Ser. No. 702,394 of Johnson now U.S. Pat. No. 4,065,063, are performed with fewer parts in the present invention.

If it is desired to increase the height of the table it is only necessary to provide slinger shoes of greater heights and provide longer bolts, all the other elements remaining the same.

While I have shown the clamping bolts 37 as passing through the slinger shoes, they could be located to one side of the shoes in a downstream position if it is desired to wear the slinger shoes to a greater depth than when the shafts pass through the center of the shoes. However, this makes the wear plates unsymmetrical and thus not interchangeable.

What is claimed is:

1. A rotary distributor table for an impact crusher comprising upper and lower table plates, plural impeller shoes between said table plates, said table plates having elongate grooves formed therein extending coaxially of said table, each shoe having upper and lower integral retaining lugs fitting in said grooves for retaining said shoes in place against the outward thrust of centrifugal force, and means for clamping said plates and shoes together.

2. In a rotary distributor table as recited in claim 1, wherein said clamping means including a bolt for each shoe, each shoe having a hole receiving its bolt, each hole being sufficiently larger than its bolt to facilitate engagement of said lugs with annular walls of said groove whereby to transfer radial forces from said bolts to said lugs.

3. A rotary distributor table for an impact crusher comprising upper and lower table plates, plural impeller shoes between said table plates, said table plates having grooves formed therein extending coaxially of said table, each shoe having upper and lower retaining lugs fitting in said grooves for retaining said shoes in place against the outward thrust of centrifugal force, means for clamping said plates and shoes together, a segmental wear plate between each pair of shoes, said shoes and table plates providing notches to receive end portions of said wear plates and retaining said wear plates in place in a direction parallel to the axis of rotation of the table, said wear plates having retaining lugs fitting in said grooves to retain said wear plates in place in a direction radially of said table.

4. A distributor table as recited in claim 3 having a central distributor member provided with edge portions, said shoes and inner faces of said table plates providing notches receiving said end portions for retaining said distributor member in place.

5. A distributor table as recited in claim 3 in which said shoes and wear plates have vertical lips disposed next to the outer edges of said table plates to protect them against excessive wear.

6. A distributor table as recited in claim 3 wherein there is a single wear plate between each pair of adjacent shoes, said plate being held in position by said shoes and the plate retaining lugs.

7. A rotary distributor table for an impact crusher comprising upper and lower table plates, plural impeller shoes between said table plates, said table plates having grooves formed therein extending coaxially of said table, each shoe having upper and lower retaining lugs fitting in said grooves for retaining said shoes in place against the outward thrust of centrifugal force, means for clamping said plates and shoes together, said clamping means comprises a bolt for each shoe, plural wear plates for each table plate, there being a single wear plate between each pair of shoes for each table plate, said shoes retaining said wear plates in position, said shoes serving as the spacing means between the table plates thereby enabling the height of the table to be varied by using sets of shoes of different heights, without requiring a change in said table plates or said wear plates, said table plates having bolt holes to facilitate location of sets of shoes at multiple equally spaced positions to enable changing the number of shoes for a table, accompanied by a change in the size of the wear plates but without requiring a change in said table plates.

8. In a rotary distributor table for an impact crusher of the type having upper and lower table plates and upper and lower wear plates for the table plates, the improvement comprising plural impeller shoes between said table plates, said shoes serving as spacers for said table plates, each shoe having lateral shoulders to receive and retain the end portion of adjacent wear plates, each shoe having a hole therethrough to receive a bolt for clamping the assembly together.

9. In a rotary distributor table as recited in claim 8 wherein each shoe has an inner shoulder to receive the edge of a central distributor member to retain the latter in place.

10. An impact crusher impeller shoe comprising:

a shoe body of general wedge shape in one direction and having a pair of oppositely directed wear faces defining the sides of said wedge shaped body, said body having a lower surface and an upper surface each provided with an island type strip defining lateral and inner shoulders, each strip having a mounting rib projecting from said strip, said body being symmetrical in such a way as to enable it to be utilized in upright or inverted position to thereby prolong the wear life of the shoe.

* * * * *